US006681726B2

(12) United States Patent
Linsbauer et al.

(10) Patent No.: US 6,681,726 B2
(45) Date of Patent: Jan. 27, 2004

(54) INTAKE SYSTEM FOR THE COMBUSTION AIR OF AN INTERNAL COMBUSTION ENGINE IN A PORTABLE HANDHELD WORK APPARATUS

(75) Inventors: Peter Linsbauer, Remshalden (DE); Jörg Schlossarczyk, Winnenden (DE); Uwe Janoske, Michelfeld (DE)

(73) Assignee: Andreas Stihl AG & Co., Waiblingen (DE)

( * ) Notice: Subject to any disclaimer, the term of this patent is extended or adjusted under 35 U.S.C. 154(b) by 0 days.

(21) Appl. No.: 10/162,898

(22) Filed: Jun. 6, 2002

(65) Prior Publication Data

US 2002/0189560 A1 Dec. 19, 2002

(30) Foreign Application Priority Data

Jun. 13, 2001 (DE) ..... 101 28 790

(51) Int. Cl.[7] ..... F01P 7/04; F02B 53/00

(52) U.S. Cl. ..... 123/41.65; 123/198 E; 55/337; 55/394; 55/DIG. 28

(58) Field of Search ..... 123/198 E, 41.56, 123/41.65, 41.7; 55/337, 394, DIG. 28

(56) References Cited

U.S. PATENT DOCUMENTS

| | | | |
|---|---|---|---|
| 3,670,480 | A | 6/1972 | Petersen |
| 3,884,658 | A | 5/1975 | Roach |
| 4,028,076 | A | 6/1977 | Fields |
| 4,248,613 | A | 2/1981 | Linhart |
| 4,276,067 | A | 6/1981 | Lindman |
| 4,303,423 | A | 12/1981 | Camplin et al. |
| 5,059,222 | A | 10/1991 | Smith |
| 5,485,817 | A | 1/1996 | Dahlberg |

FOREIGN PATENT DOCUMENTS

| | | |
|---|---|---|
| DE | 44 35 430 | 4/1995 |
| DE | 195 20 533 | 3/1996 |
| DE | 195 31 504 | 2/1997 |
| FR | 1 006 499 | 1/1952 |
| FR | 2 326 573 | 4/1977 |
| FR | 2 426 499 | 12/1979 |
| GB | 2 274 408 | 7/1994 |
| SU | 1 477 451 | 5/1989 |
| SU | 1 590 610 | 9/1990 |

*Primary Examiner*—Noah P. Kamen
(74) *Attorney, Agent, or Firm*—Walter Ottesen

(57) ABSTRACT

The invention relates to an intake system (1) for the combustion air (2) of an internal combustion engine (3) in a portable handheld work apparatus (4). The intake system (19) includes a filter housing (5) having an air filter (6) for purifying the combustion air (2). The clean space (8) of the air filter (6) is fluidly connected to an outlet opening (10) of the filter housing (5). The outlet opening (10) communicates with a carburetor (7) of the engine (3). A centrifugal-force separator (13) is mounted forward of the air filter (6) for separating large amounts of dust in the inducted combustion air (2). The separator (13) is so positioned ahead of the filter housing (5) that a central core flow (14) of the separator has a lower particle density (15) and is supplied to the filter (6). A tangential flow (16) surrounds the central core flow (14) in the interior of the separator (13). The tangential flow (16) has a great amount of dust or dirt and is conducted away via the suction side (11) of a blower (12), especially of a cooling-air blower (19) of the engine (3) having vanes on the back side thereof.

13 Claims, 4 Drawing Sheets

INTAKE SYSTEM FOR THE COMBUSTION AIR OF AN INTERNAL COMBUSTION ENGINE IN A PORTABLE HANDHELD WORK APPARATUS

BACKGROUND OF THE INVENTION

U.S. Pat. No. 5,526,777 discloses an intake system for an internal combustion engine of a portable handheld work apparatus, namely, a motor-driven chain saw. A cooling-air blower of the chain saw moves air into an air filter housing. The clean space of the air filter is connected to an intake channel of a carburetor of the internal combustion engine. Dust-laden ambient air is drawn by suction via an inlet opening into the contaminant space of the filter housing. This dust-laden air is conducted past the air filter and is supplied to the cooling air flow via an outlet opening on the filter housing. The air filter is charged with dust in an extreme manner depending upon the ambient conditions at the location where the chain saw is used. During operation of the intake system, different flow resistances of the air filter result in dependence upon the layer thickness of the deposited dust. The operation of the engine can thereby be affected.

SUMMARY OF THE INVENTION

It is an object of the invention to provide an intake system for the combustion air of an internal combustion engine which ensures a disturbance-free operation of the engine even under operating conditions wherein very intense amounts of dust are present.

The intake arrangement of the invention is for the combustion air of an internal combustion engine including an internal combustion engine of a portable handheld work apparatus. The engine includes a carburetor and the intake arrangement includes: a filter housing defining an interior; an air filter mounted in the filter housing for filtering the combustion air supplied to the engine; the air filter being mounted in the filter housing so as to partition the interior into a contaminant space having an inlet opening and a clean space fluidly connected to the carburetor; a blower for moving a flow of the combustion air laden with dust toward the filter housing; a centrifugal-force separator for receiving the flow of combustion air and for dividing the flow into a central core flow having a low particle density of the dust and a tangential flow surrounding the core flow with the tangential flow having a particle density of the dust greater than the low particle density; the centrifugal-force separator having discharge means for conducting the tangential flow away from the centrifugal-force separator; and, the centrifugal-force separator having conducting means for conducting the central core flow into the inlet opening and the contaminant space.

A centrifugal-force separator is mounted forward of the filter housing in order to prevent a clogging of the air filter especially when there is a high dust content in the ambient air of a portable handheld motor-driven work apparatus. During the operation of the centrifugal-force separator or cyclone, a central core flow with low particle density is present in the interior of the separator, that is, a low-dust zone having preferably very small particles and a tangential flow which surrounds the core flow. The tangential flow has a greater particle density with particles of larger average diameter. The airflow, which is needed for separation, in the centrifugal-force separator is generated by the cooling-air blower. The core flow of the cyclone is conducted to the contaminant space of the filter housing; whereas, the tangential flow of the cyclone is preferably conducted away via the suction end of the blower. In this way, the low-dust air flows toward the air filter and the air filter does not become rapidly clogged with dust. This is of significant advantage in cutoff machines which generate intense quantities of dust at the cutting or scraping tool.

In an air-cooled internal combustion engine, it is practical to utilize the cooling-air blower for generating the airflow through the centrifugal-force separator. It is advantageous that the blower be a blower having rear-mounted vanes. The blower wheel of the cooling-air blower is provided with blower vanes on its rear side. As a centrifugal-force separator, cyclones, preferably axial cyclones or turbofilters and the like are suitable. Axial cyclones and turbofilters are characterized by a cylindrically-shaped housing; whereas, cyclones have a conically tapered section. All centrifugal-force separators have in common that, during operation, a rotating movement of air is present in the interior with a low path velocity at the center of the separator and a high peripheral or path velocity in the peripheral regions.

It is practical to configure the housing of the centrifugal-force separator essentially as one piece with the filter housing. In this way, a compact configuration of the entire intake system results. The core flow is then preferably taken with a dip pipe which is mounted at an axial end of the centrifugal-force separator. The tangential flow is taken tangentially from the centrifugal-force separator.

For assembly purposes, it is practical to form the filter housing from two parts, approximately halfshell-shaped parts. The halfshell-shaped filter housing parts are tightly connected in the assembled condition of the filter housing with threaded fasteners or are connected in some other way so as to be form-tight or force-tight. The dip tube on the centrifugal-force separator is configured as one piece with a portion of the filter housing, preferably with a cover of the filter housing. The second part of the filter housing is preferably fixed to a flange of the carburetor of the engine.

In another embodiment of the intake system, an axial cyclone is applied to preclean the combustion air. The axial cyclone is formed of a cylindrically-shaped housing having a first axial end with a conducting arrangement mounted in the interior of the housing at this axial end. Dirt-laden combustion air is moved by a blower to the conducting arrangement from outside of the axial cyclone and the conducting arrangement imparts a rotational movement to the in-flowing combustion air in the interior of the housing. In this way, a central core flow having a low particle density forms as does a tangential flow which surrounds the core flow and has a greater particle density than in the core flow. The axial cyclone has an axial second end lying downstream and a preferably cylindrically-shaped dip pipe projects axially into the housing at this axial second end. The core flow is supplied to the contaminant space of the filter housing through the dip pipe. The tangential flow flows out radially through an opening at the second axial end of the axial cyclone. The tangential flow conducts dust away so that the combustion air is purified of larger particles by the axial cyclone. The length of the axial cyclone is approximately twice as large as its diameter.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
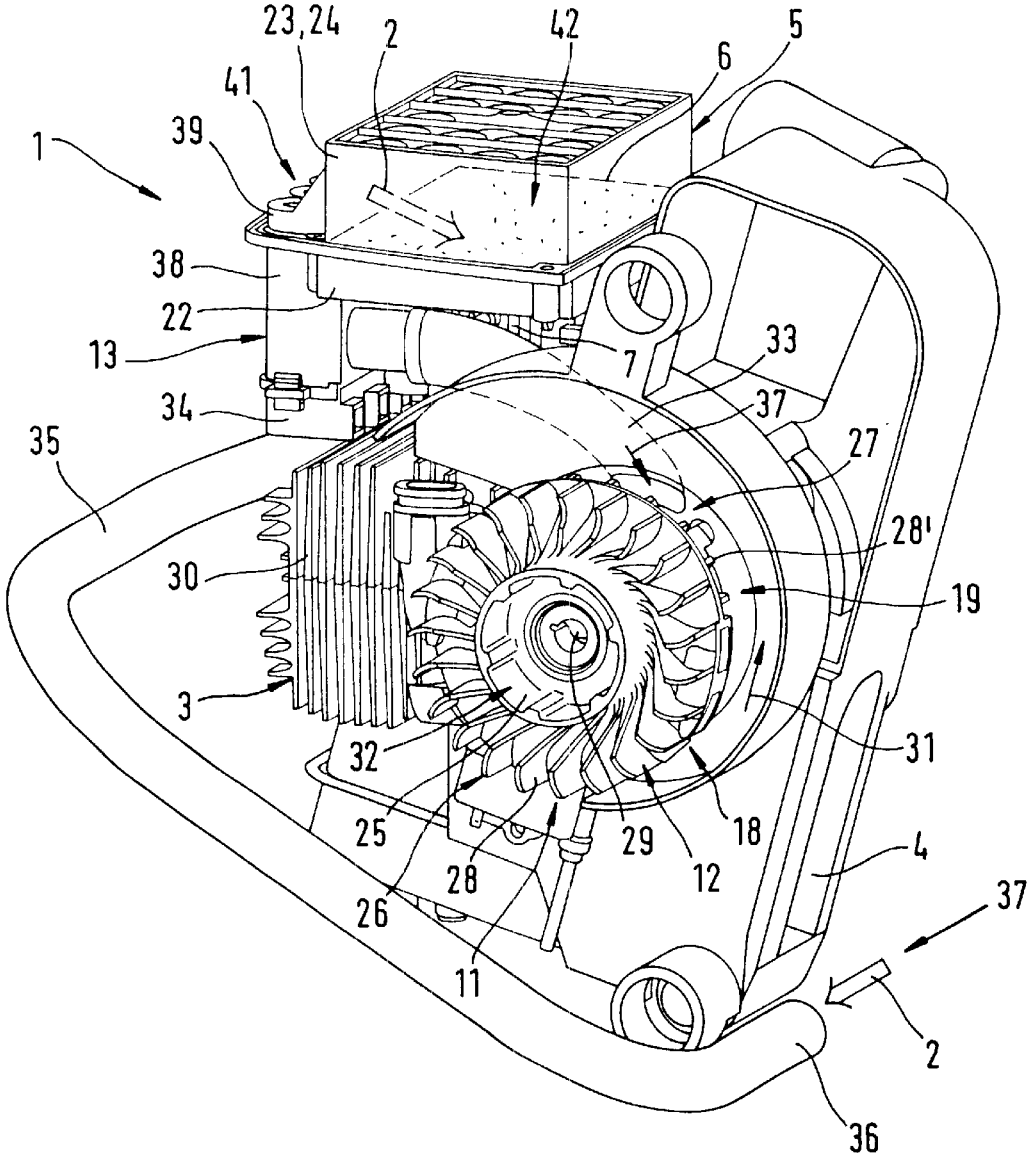
FIG. 1 is a schematic perspective view of an intake arrangement according to an embodiment of the invention.

FIG. 1 is a schematic view of an intake arrangement 1 for combustion air 2 on an internal combustion engine 3 of a partially illustrated work apparatus 4. Dirt, such as dust or the like, is generated during the operation of such work apparatus, especially with cutoff machines. The dirt can be organic or inorganic particles such as stone powder or metal chips.

The combustion air 2, which is drawn in by the engine 3, must be purified before entry into the combustion chamber of the engine 3 in order to avoid wear. For this purpose, the carburetor 7 is provided with an intake arrangement 1 which comprises a centrifugal-force separator 13 and a filter housing 5 having an air filter 6. A blower 12 is provided for feeding the combustion air into the intake arrangement 1. A cooling-air fan 18 is advantageously used as blower 12, which, in the embodiment shown, is a radial blower 19 having rear-mounted vanes. A fan wheel 25 of the radial blower 19 is shown. The fan wheel 25 is provided on both sides (26, 27) with axially and radially extending fan vanes 28. The fan wheel 25 is fixed on an end 29 of the crankshaft of the engine 3. The fan wheel simultaneously functions as a rotor for an ignition system of the engine 3.

In the assembled state of the engine 3, the fan wheel 25 is covered by a housing cover. The fan wheel 25 rotates in the direction of arrow 31 during operation of the engine 3. The axial region 32 of the fan wheel 25 is the suction side 11. The fan wheel moves air from the suction side 11 in a radial direction. With the aid of the housing cover (not shown), the cooling-air flow is conducted to the cooling ribs 30 of the engine 3.

A curved discharge pipe 33 extends tangentially from the centrifugal-force separator 13 to a suction side of the blower 19. An underpressure is present in the discharge pipe 33 during operation of the blower 19 and this underpressure propagates via the interior of the separator 13 and via an intake pipe 35 which opens at an axial end 34 of the separator 13. The underpressure is also present at an intake opening 36 of the intake pipe 35. Combustion air 2 is drawn by suction from the ambient of the work apparatus 4 through the opening 36 together with dust 37 contained in the air and reaches the interior of the separator 13 via the intake pipe 35.

Figure 2:
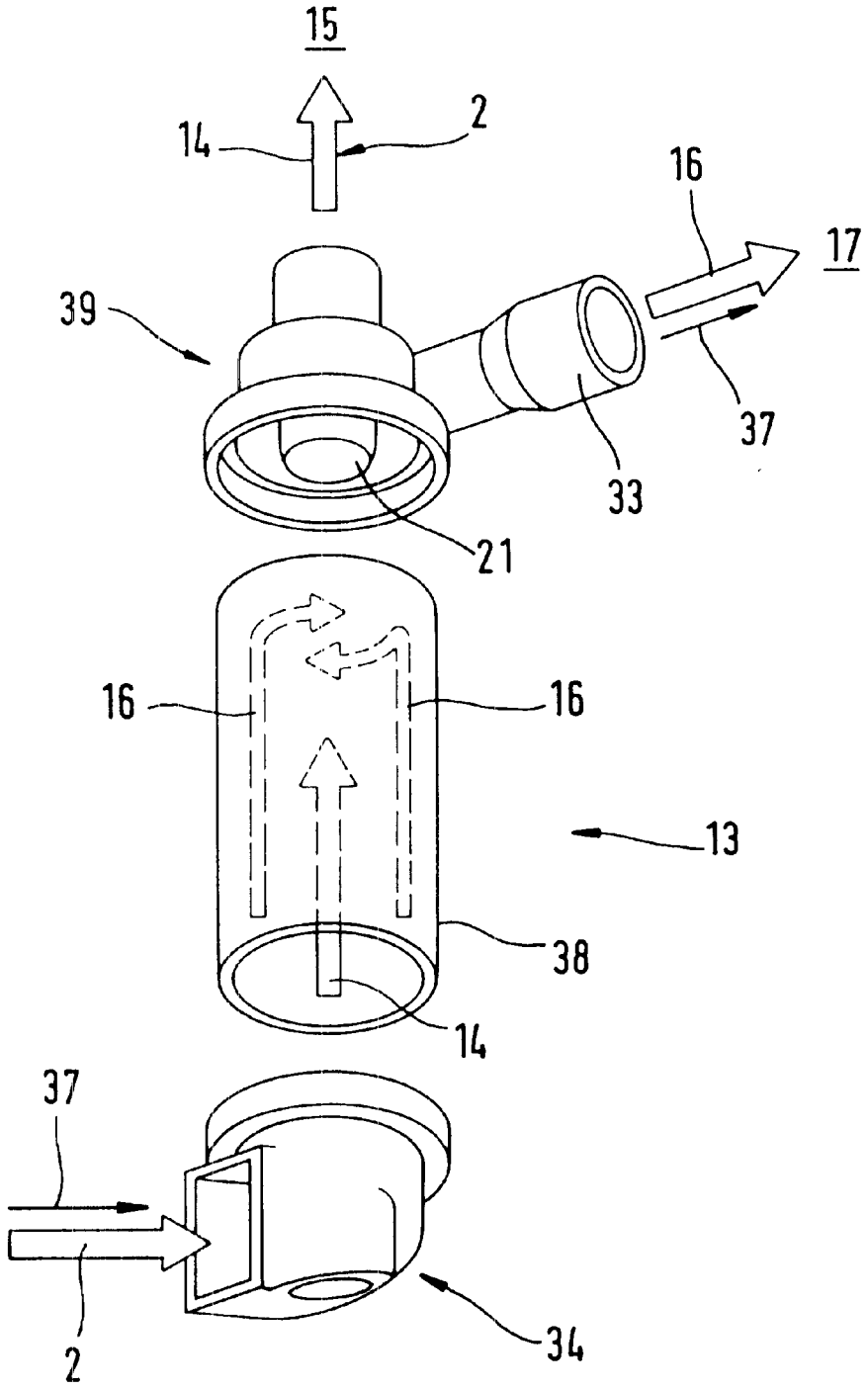
FIG. 2 is an exploded perspective view of a centrifugal-force separator.

The housing 38 of the separator 13 has the shape of a parallelepiped when viewed from the outside and is cylindrically shaped in the interior thereof. In the housing 38, a rotational movement is imparted to the in-flowing combustion air 2. A core flow 14 is formed in the center of the separator 13 and a tangential flow 16 is formed which radially surrounds the core flow 14. The core flow 14 has a particle density 15 which is less than the particle density 17 of the tangential flow 16. In addition, the mean diameters of the particles in the core flow are less and especially significantly less than the mean diameters of the particles in the tangential flow 16. As shown in FIG. 2, the tangential flow 16 is conducted tangentially via the discharge pipe 33 to the blower 19. In this way, the main mass of the dust, which passes through the opening 36 of the intake pipe 35, is again removed from the separator 13 after passing through a part length of the housing 38 of the separator. The core flow 14 moves rotationally in the interior of the separator 13 and axially through an axial end 39 of the housing 38 of the separator 13 and is fed to the air filter 6. The axial end 39 of the housing 38 lies opposite the axial end 34.

In the embodiment shown, the filter housing 5 comprises two parts, namely, a lower part 22 and a cover 24. The lower part is approximately quadratic in its outline and has a half-shell shape and the cover 24 is approximately the same size in its outline and it too has a half-shell shape. A fluid connection 41 to the separator 13 is formed as one piece with the cover 24. In the embodiment of FIG. 1, this fluid connection 41 is formed as a dip pipe for the centrifugal-force separator 13 shown in FIG. 2. The dip pipe functions to pick up the core flow 14 of the separator 13 and to feed the core flow 14 into a contaminant space 42 of the filter 6. The pick up of the core flow 14 from the separator 13 takes place because of the suction action of the engine 3 when drawing the air/fuel mixture via the carburetor 7 into a crankcase, that is, into a combustion chamber of the engine 3.

FIG. 2 shows an exploded perspective view of a centrifugal-force separator 13. A dip pipe 21 is shown at the axial end 39 of the housing 38 and, in the embodiment shown, the dip pipe 21 projects into the separator with an axial length of approximately ⅛ to 1/10 of the axial length of the housing 38 of the separator. In contrast to the centrifugal-force separator shown in FIG. 1, the discharge pipe 33 lies in the direct proximity of the dip pipe 21 tangentially thereof and opens into the annular space between the dip pipe 21 and the housing.

The components of the intake system 1 such as the intake pipe 35, the housing 38 of the separator 13 as well as the parts 23 and 22 of the filter housing 5 and the discharge pipe 33 preferably are made of plastic. The two-part filter housing shown in FIG. 1 has parts 22 and 23 which are tightly connected to each other with threaded fasteners or are riveted. In lieu of the filter housing of FIG. 1, the filter housing 5 and parts of the housing 38 of the separator 13 can be configured as one piece. In lieu of the cyclone shown in the embodiment, an axial cyclone or turbofilter can also be used. It can be practical to connect several centrifugal-force separators in parallel or in series ahead of the filter housing 5. In this way, a large amount of dust in the inducted combustion air 2 can be separated via the blower 19 before the combustion air is supplied to the air filter 6.

Figure 3:
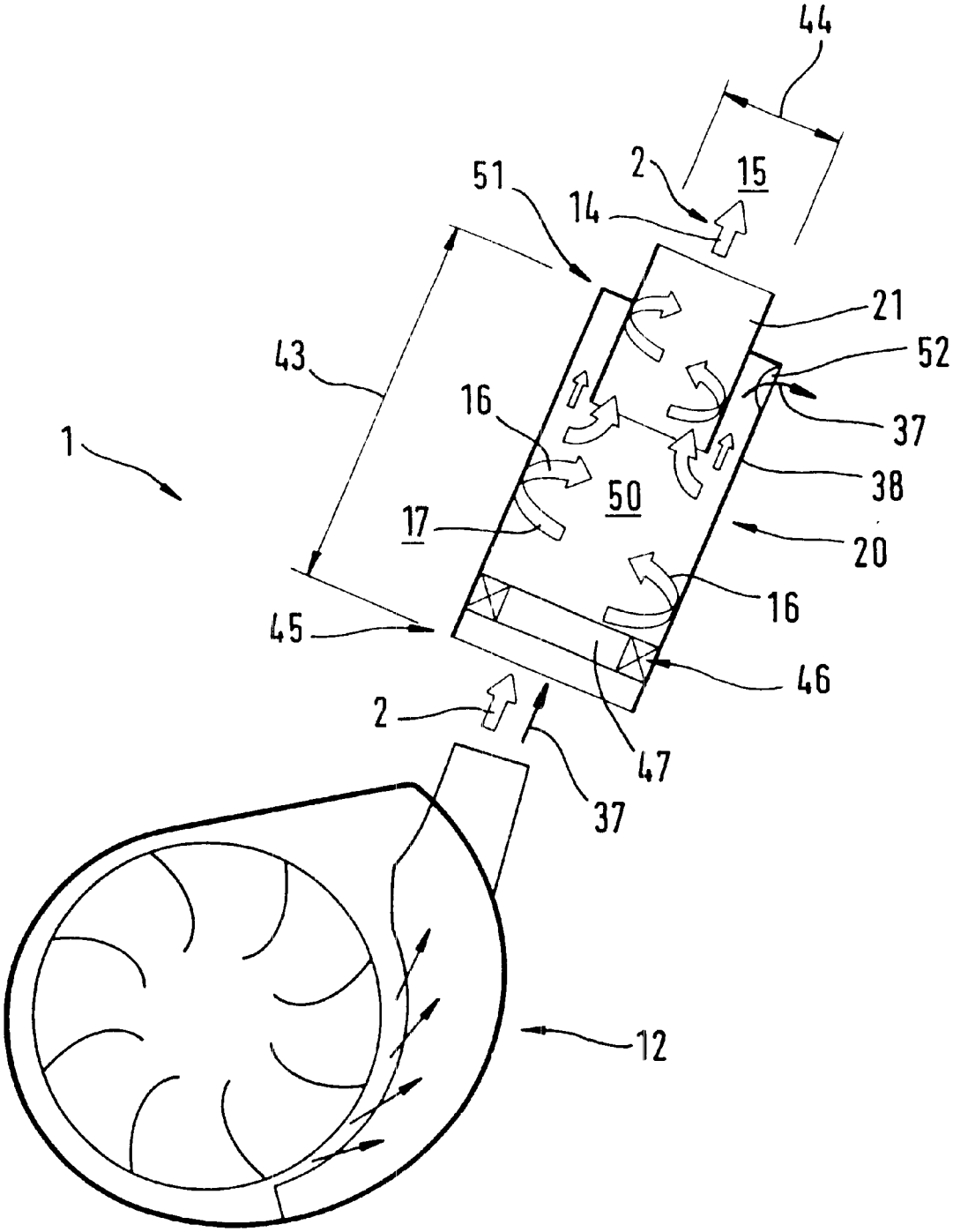
FIG. 3 is a schematic of an intake arrangement having an axial cyclone.

FIG. 3 shows a schematic of another intake system 1 for the combustion air 2 of an internal combustion engine. In contrast to the intake system shown in FIG. 1, an axial cyclone 20 is used in the embodiment of FIG. 3. The axial cyclone 20 is configured from a cylindrically-shaped housing 38 whose axial length 43 is approximately twice the size of its diameter 44. The axial cyclone 20 has a length 43 of approximately 80 mm and a diameter of approximately 30 mm. The housing 30 is made of plastic, preferably a thermoplastic plastic.

Figure 5:
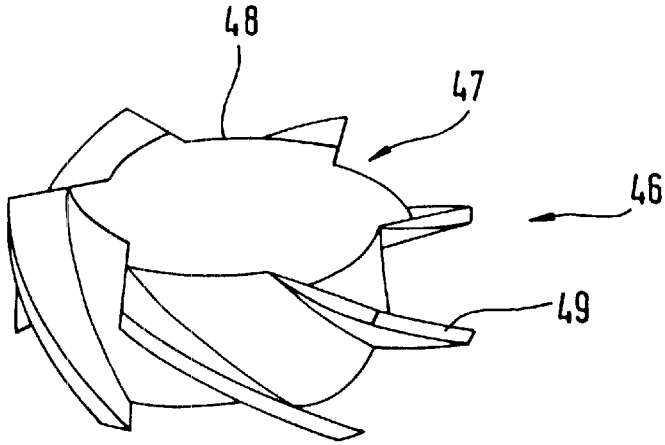
FIG. 5 is a perspective view of a conducting arrangement.

The blower 12 is configured as a radial blower and moves combustion air 2 together with dirt 37 to a first axial end 45 of the axial cyclone 20. A conducting arrangement 46 (FIG. 5) in the form of an axial blower wheel 47 is fixed in the interior of the housing 38 at the axial end 45 thereof. The axial blower wheel 47 extends essentially over the clear cross section of the housing 38. The blower wheel 47 is shown in perspective in FIG. 5 and imparts a rotational movement to the combustion air 2 in the interior of the housing 38. The blower wheel 47 does this with its six vanes 49 arranged on the hub 48 of the blower wheel 47 at a pitch angle of approximately 30°. In this way, a tangential flow 16 is formed with significant portions of the dust 37. The tangential flow 16 surrounds the core flow 14 in the center 50 of the housing 38.

The particle density 17 of the tangential flow 16 is greater, and preferably significantly greater, than the particle density 15 of the core flow 14 as described with respect to the centrifugal-force separator 13 shown in FIG. 2. The dip pipe 21 projects at the axial end 51 of the housing 38 into the interior of the housing. The axial end 51 lies opposite the axial end 45. The housing 38 extends at its axial end 51 seal tight to the outer wall 53 of the dip pipe 21. The dip pipe 21 has a diameter 44 which permits the pipe 21 to pick up the core flow 14 in the interior of the housing 38 in its radial extension and to direct the core flow out of the axial cyclone 20. The core flow 14 is then supplied to the air filter 6 in the filter housing 5 at the contaminant space side as shown in FIG. 1.

Figure 4:
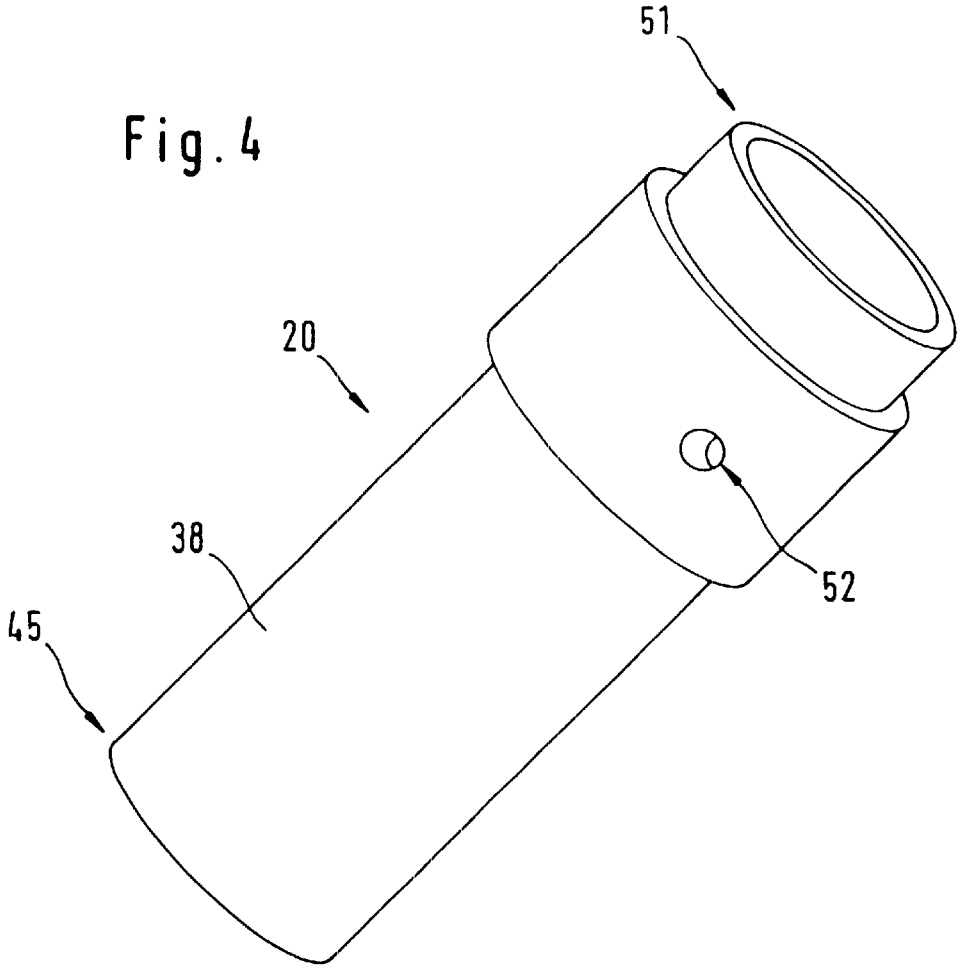
FIG. 4 is a perspective view of an axial cyclone.

A radially and tangentially guided opening 52 is provided in the housing in the region of the axial extension of the dip pipe 21 in the interior of the housing 38. The opening 52 is preferably cylindrical. In the embodiment of the axial cyclone 20 shown in FIG. 4, the opening 52 has a diameter approximately 1/7 of the diameter 44 of the housing 38. The opening 52 serves for directing away the dust 37, which is contained in the tangential flow 16, from the axial cyclone 20 and away from the portable handheld work apparatus. Thus, with the intake system 1 for combustion air 2 shown partially in FIG. 3, combustion air 2 with dust 37 is supplied via the blower 12 in the axial direction to the axial cyclone 20 and precleaned combustion air 2 is conducted to the air filter 6 in axial direction to the axial cyclone 20.

It is understood that the foregoing description is that of the preferred embodiments of the invention and that various changes and modifications may be made thereto without departing from the spirit and scope of the invention as defined in the appended claims.

What is claimed is:

1. An intake arrangement for the combustion air of an internal combustion engine including an internal combustion engine of a portable handheld work apparatus, the engine including a carburetor and the intake arrangement comprising:

a filter housing defining an interior;

an air filter mounted in said filter housing for filtering the combustion air supplied to said engine;

said air filter being mounted in said filter housing so as to partition said interior into a contaminant space having an inlet opening and a clean space fluidly connected to said carburetor;

a cooling air fan of said engine for moving a flow of said combustion air laden with dust toward said filter housing and said cooling air fan having rear-mounted vanes;

a centrifugal-force separator for receiving said flow of combustion air and for dividing said flow into a central core flow having a low particle density of said dust and a tangential flow surrounding said core flow with said tangential flow having a particle density of said dust greater than said low particle density;

said centrifugal-force separator having discharge means for conducting said tangential flow away from said centrifugal-force separator;

said cooling air fan conducting away said tangential flow discharged from said centrifugal-force separator; and, said centrifugal-force separator having conducting means for conducting said central core flow into said inlet opening and said contaminant space.

2. The intake arrangement of claim 1, wherein said centrifugal-force separator is a cyclone.

3. The intake arrangement of claim 1, wherein said centrifugal-force separator is an axial cyclone.

4. The intake arrangement of claim 1, wherein said centrifugal-force separator is a turbofilter.

5. The intake arrangement of claim 1, wherein said conducting means is a dip tube for conducting said core flow away from said centrifugal-force separator and toward said contaminant space of said filter housing.

6. An intake arrangement for the combustion air of an internal combustion engine including an internal combustion engine of a portable handheld work apparatus, the engine including a carburetor and the intake arrangement comprising:

a filter housing defining an interior;

an air filter mounted in said filter housing for filtering the combustion air supplied to said engine;

said air filter being mounted in said filter housing so as to partition said interior into a contaminant space having an inlet opening and a clean space fluidly connected to said carburetor;

a blower for moving a flow of said combustion air laden with dust toward said filter housing;

a centrifugal-force separator for receiving said flow of combustion air and for dividing said flow into a central core flow having a low particle density of said dust and a tangential flow surrounding said core flow with said tangential flow having a particle density of said dust greater than said low particle density:

said centrifugal-force separator having discharge means for conducting said tangential flow away from said centrifugal-force separator;

said centrifugal-force separator having conducting means for conducting said central core flow into said inlet opening and said contaminant space; and, said blower being a cooling-air fan of said engine.

7. The intake arrangement of claim 6, wherein said cooling-air fan has rear-mounted vanes.

8. An intake arrangement for the combustion air of an internal combustion engine including an internal combustion engine of a portable handhold work apparatus, the engine including a carburetor and the intake arrangement comprising:

a filter housing defining an interior;

an air filter mounted in said filter housing for filtering the combustion air supplied to said engine;

said air filter being mounted in said filter housing so as to partition said interior into a contaminant space having an inlet opening and a clean space fluidly connected to said carburetor;

a blower for moving a flow of said combustion air laden with dust toward said filter housing:

a centrifugal-force separator for receiving said flow of combustion air and for dividing said flow into a central core flow having a low particle density of said dust and a tangential flow surrounding said core flow with said tangential flow having a particle density of said dust greater than said low particle density;

said centrifugal-force separator having discharge means for conducting said tangential flow away from said centrifugal-force separator;

said centrifugal-force separator having conducting means for conducting said central core flow into said inlet opening and said contaminant space; and, said centrifugal-force separator being configured essentially as one piece with said filter housing.

9. An intake arrangement for the combustion air of an internal combustion engine including an internal combustion engine of a portable handheld work apparatus, the engine including a carburetor and the intake arrangement comprising:

a filter housing defining an interior;

an air filter mounted in said filter housing for filtering the combustion air supplied to said engine;

said air filter being mounted in said filter housing so as to partition said interior into a contaminant space having an inlet opening and a clean space fluidly connected to said carburetor;

a blower for moving a flow of said combustion air laden with dust toward said filter housing;

a centrifugal-force separator for receiving said flow of combustion air and for dividing said flow into a central core flow having a low particle density of said dust and a tangential flow surrounding said core flow with said tangential flow haying a particle density of said dust greater than said low particle density;

said centrifugal-force separator having discharge means for conducting said tangential flow away from said centrifugal-force separator;

said centrifugal-force separator having conducting means for conducting said central core flow into said inlet opening and said contaminant space:

said conducting means being a dip tube for conducting said core flow away from said centrifugal-force separator and toward said contaminant space of said filter housing; and, said filter housing including first and second housing parts and said dip tube being formed as one piece with said first housing part.

10. The intake arrangement of claim 9, wherein said intake arrangement includes a cover for said filter housing facing away from said carburetor; and, said dip tube is formed as one piece with said cover.

11. An intake arrangement for the combustion air of an internal combustion engine including an internal combustion engine of a portable handheld work apparatus, the engine including a carburetor and the intake arrangement comprising:

a filter housing defining an interior;

an air filter mounted in said filter housing for filtering the combustion air supplied to said engine;

said air filter being mounted in said filter housing so as to partition said interior into a contaminant space having an inlet opening and a clean space fluidly connected to said carburetor;

a blower for moving a flow of said combustion air laden with dust toward said filter housing;

a centrifugal-force separator for receiving said flow of combustion air and for dividing said flow into a central core flow having a low particle density of said dust and a tangential flow surrounding said core flow with said tangential flow having a particle density of said dust greater than said low particle density;

said centrifugal-force separator having discharge means for conducting said tangential flow away from said centrifugal-force separator;

said centrifugal-force separator having conducting means for conducting said central core flow into said inlet opening and said contaminant space;

said centrifugal-force separator being an axial cyclone; and, said blower being mounted for directing said flow of combustion air to said axial cyclone.

12. The intake arrangement of claim 11, wherein said blower is a cooling-air fan of said engine.

13. The intake arrangement of claim 11, wherein said axial cyclone has a length approximately equal to twice the diameter thereof.

* * * * *

UNITED STATES PATENT AND TRADEMARK OFFICE

CERTIFICATE OF CORRECTION

PATENT NO. : 6,681,726 B2 
DATED : January 27, 2004
INVENTOR(S) : Peter Linsbauer, Joerg Schlossarczyk and Uwe Janoske It is certified that error appears in the above-identified patent and that said Letters Patent is hereby corrected as shown below:

Column 6,
Line 46, delete “handhold” and substitute -- handheld -- therefor.

Column 7,
Line 25, delete “haying” and substitute -- having -- therefor.
Line 32, delete “space:” and substitute -- space; -- therefor.

Signed and Sealed this

Sixth Day of July, 2004

JON W. DUDAS
*Acting Director of the United States Patent and Trademark Office*